US012221253B2

(12) United States Patent
Myers

(10) Patent No.: US 12,221,253 B2
(45) Date of Patent: Feb. 11, 2025

(54) DRINKING AND SEALING LIDS FOR VESSELS AND ASSOCIATED DEVICES AND METHODS

(71) Applicant: Ceres Chill Co., Bainbridge Island, WA (US)

(72) Inventor: Elizabeth J. Myers, Bainbridge Island, WA (US)

(73) Assignee: CERES CHILL CO., Bainbridge Island, WA (US)

( * ) Notice: Subject to any disclaimer, the term of this patent is extended or adjusted under 35 U.S.C. 154(b) by 0 days.

(21) Appl. No.: 17/990,464

(22) Filed: Nov. 18, 2022

(65) Prior Publication Data

US 2023/0159231 A1 May 25, 2023

Related U.S. Application Data

(60) Provisional application No. 63/281,470, filed on Nov. 19, 2021.

(51) Int. Cl.
*B65D 43/02* (2006.01)
*A47G 19/22* (2006.01)
*B65D 47/06* (2006.01)

(52) U.S. Cl.
CPC ..... *B65D 43/0212* (2013.01); *A47G 19/2272* (2013.01); *B65D 47/06* (2013.01);
(Continued)

(58) Field of Classification Search
CPC ..... B65D 43/0212; B65D 47/06; B65D 2543/00046; B65D 2543/00305;
(Continued)

(56) References Cited

U.S. PATENT DOCUMENTS 2,269,223 A * 1/1942 Porthouse ..... A61J 11/045 215/11.1
2,443,560 A * 6/1948 Goodson ..... A61J 11/02 215/11.5

(Continued)

OTHER PUBLICATIONS

International Search Report and Written Opinion mailed Mar. 21, 2023 in International Patent Application No. PCT/US22/50461, 14 pages.

(Continued)

*Primary Examiner* — James N Smalley
(74) *Attorney, Agent, or Firm* — Perkins Coie LLP

(57) ABSTRACT

A sip lid for a children's drinking vessel includes a spout component having a first end region and a second end region opposite to the first end region. The spout component is shaped and sized to be received within a child's mouth. The first end region comprises one or more openings configured to allow liquid to be extracted through the spout component when the child is applying suction to the spout component. The sip lid also includes a base component extending from the second end region of the spout component and surrounding the spout component. The base component is made from an elastic material configured to allow the base component to stretch over differently sized mouths of drinking vessels to form a liquid-tight seal between the base component and the drinking vessels.

27 Claims, 11 Drawing Sheets

(52) U.S. Cl.
CPC ..... *B65D 2543/00046* (2013.01); *B65D 2543/00305* (2013.01); *B65D 2543/00537* (2013.01); *B65D 2543/0099* (2013.01)

(58) Field of Classification Search
CPC .. B65D 2543/00537; B65D 2543/0099; A47G 19/022
USPC ..... 220/287, 717; 215/388, 389
See application file for complete search history.

(56) References Cited

U.S. PATENT DOCUMENTS

| | | | | |
|---|---|---|---|---|
| 2,693,187 | A * | 11/1954 | Perreault | A61J 11/02 215/11.1 |
| 7,134,564 | B2 * | 11/2006 | Verbovszky | A61J 11/006 220/717 |
| 8,286,827 | B2 | 10/2012 | Yacktman | |
| 9,848,721 | B2 | 12/2017 | Turner et al. | |
| 10,220,984 | B1 | 3/2019 | Vigoureux | |
| 2003/0192891 | A1 * | 10/2003 | Ziegler | A47G 19/2272 220/717 |
| 2004/0000551 | A1 | 1/2004 | Flink et al. | |
| 2007/0090081 | A1 * | 4/2007 | Briscoe | A47G 19/2272 220/717 |
| 2012/0145727 | A1 | 6/2012 | Gammage | |
| 2013/0068715 | A1 * | 3/2013 | Sakulsacha | A47G 19/2272 215/11.1 |
| 2015/0359365 | A1 * | 12/2015 | Feeley | A47G 19/2272 220/713 |
| 2016/0051069 | A1 * | 2/2016 | Turner | A61J 11/02 222/567 |

OTHER PUBLICATIONS

Boon SNUG Spout Sippy Lids, Assorted Color (Pack of 3. Retrieved on Nov. 18, 2022 at <https://www.amazon.com/Boon-Spout-Sippy-Assorted-Colors/dp/B08KB5R2N7/ref=cm_cr_arp_d_product_top?ie=UTF8>, 10 pages.

Beabies Stretchable Silicone Sippy Cup Lids for Regular Cups between 2.68" to 3.35" in diameter. Retrieved on Nov. 18, 2022 at < https://www.amazon.com/Beabies-Stretchable-Silicone-Sippy-Lids/dp/B0921T6MLY/ref=sr_1_3_sspa?crid=3VHN7EDQPUXG8&keywords=silicone+sippy+cup+lids&qid=1666386004&qu=eyJxc2MiOilzLjc3liwicXNhljoiMy40NylslnFzcCl6ljMuMTMifQ%3D%3D&s=home-garden&sprefix=silicone+si%2Cgarden%2C134&sr=1-3-spons&psc=1>, 11 pages.

Sippy Cup Lids by Healthy Sprouts—(5 Pack)—Spill Proof Silicone Sippy Lids—Great for Toddlers, Infants, Babies (Purple, Pink, Green). Retrieved on Nov. 18, 2022 at <https://www.amazon.com/Healthy-Sprouts-Silicone-Sippy-Lids/dp/B075ZBD7JX/ref=sr_1_1_sspa?crid=3VHN7EDQPUXG8&keywords=silicone%2Bsippy%2Bcup%2Blids&qid=1666386137&qu=eyJxc2MiOilzLjc3liwicXNhljoiMy40NylslnFzcCl6ljMuMTMifQ%3D%3D&s=home-garden&sprefix=silicone%2Bsi%2Cgarden%2C134&sr=1-1-Spons&th=1>, 10 pages.

* cited by examiner

DRINKING AND SEALING LIDS FOR VESSELS AND ASSOCIATED DEVICES AND METHODS

CROSS-REFERENCE TO RELATED APPLICATION

This application claims the benefit of U.S. Provisional Patent Application No. 63/281,470, entitled "Drinking and Sealing Lid for Baby Bottles," filed on Nov. 19, 2021, which is incorporated herein by reference in its entirety.

TECHNICAL FIELD

The present technology relates to drinking vessels and, in particular, to drinking and sealing lids for drinking containers and associated systems and methods.

BACKGROUND

Conventionally sip cups and sip bottles include lids that only fit specific cups and bottles for which they are designed. Conventional sippy cups can also leak when inverted or tipped on their side. Some require the user to close the lid (e.g., with an additional top) and seal them up after consuming liquids to avoid leaks. Children may forget or be unable to close the tops. This is particularly problematic when caregivers are traveling with the vessels in their diaper bags, luggage, or vehicles. Liquids may leak and spill to cause messes and damage.

Because conventional sippy lids only fit specific bottles and cups, caregivers are often required to bring entire vessels with the connective sip lids with them whether they are traveling, on a short outing, or in their own homes. When beverages are purchased and come in vessels with differently sized mouths, caregivers must empty the contents into the sip lid vessel. This creates circumstances where caregivers must purchase specialized drinking vessels for toddlers with sip lids rather than using sip lids that would work with a variety of different bottles and cups.

Caregivers must also dispose of readily available beverage containers and also wash multiple sip lid drink vessels rather than allowing their child to drink directly from the commercial, easily accessible vessels provided or utilizing the baby bottles they already have on hand from when the child was an infant. As a result of prior art deficiencies, children and caregivers must carry entire sip lid vessels with them to allow children to consume beverages without spilling or aspirating the beverage.

The various features of novelty that characterize the disclosure are pointed out with particularity in the claims annexed to and forming a part of the disclosure. For a better understanding of the disclosure, its operating advantages, and specific objects attained by its use, reference should be had to the drawing and descriptive matter in which there are illustrated and described preferred embodiments of the disclosure. Other objects and features of the present disclosure will become apparent from the following detailed description considered in conjunction with the accompanying drawings. It is to be understood, however, that the drawings are designed solely for purposes of illustration and not as a definition of the limits of the disclosure, for which reference should be made to the appended claims. It should be further understood that the drawings are not necessarily drawn to scale and that, unless otherwise indicated, they are merely intended to conceptually illustrate the structures and procedures described herein.

Other features of the disclosure will be in part apparent and in part pointed out hereinafter.

BRIEF DESCRIPTION OF THE DRAWINGS

Many aspects of the present disclosure can be better understood with reference to the following drawings. The components in the drawings are not necessarily to scale. Instead, emphasis is placed on clearly illustrating the principles of the present disclosure.

DETAILED DESCRIPTION

Disclosed herein is a sip lid configured to be coupled with differently sized and shaped drinking vessel mouths. The sip lid is made of an elastic material (e.g., silicone) that allows the sip lid to be stretched around the mouth and a neck of a drinking vessel. An inner surface of the sip lid can include one or more ridges that are configured to form a liquid-tight seal with the mouth of the drinking vessel. In some examples, the one or more ridges form a friction fit within threads of the mouth of the drinking vessel to form the liquid-tight seal. The disclosed sip lid provides for a convenient and economical sip lid that can be used for a variety of drinking vessels having different shaped and sized mouths that include or do not include threads. Importantly, the sip lid provides for a liquid-tight coupling to the differently sized bottles without spilling. As an example, the sip lid can be used for standard baby bottles thereby extending the usage time of the baby bottles as a child grows out of using nipples. The disclosed sip lid can also allow caregivers to carry a small flexible sip top that can readily connect to drink bottles purchased on the go.

Specific details of several embodiments of the present technology are described herein with reference to FIG. 1A through FIG. 4. The present technology, however, can be practiced without some of these specific details. In some instances, well-known structures and techniques often associated with nipple shields and the like, have not been shown in detail so as not to obscure the present technology. The terminology used in the description presented below is intended to be interpreted in its broadest reasonable manner, even though it is being used in conjunction with a detailed description of certain specific embodiments of the disclosure. Certain terms can even be emphasized below; however, any terminology intended to be interpreted in any restricted manner will be overtly and specifically defined as such in this Detailed Description section.

The accompanying Figures depict embodiments of the present technology and are not intended to be limiting of its scope. The sizes of various depicted elements are not necessarily drawn to scale, and these various elements can be arbitrarily enlarged to improve legibility. Component details can be abstracted in the Figures to exclude details such as the position of components and certain precise connections between such components when such details are unnecessary for a complete understanding of how to make and use the present technology. Many of the details, dimensions, angles, and other features shown in the Figures are merely illustrative of particular embodiments of the disclosure. Accordingly, other embodiments can have other details, dimensions, angles, and features without departing from the spirit or scope of the present technology.

Figure 1A:
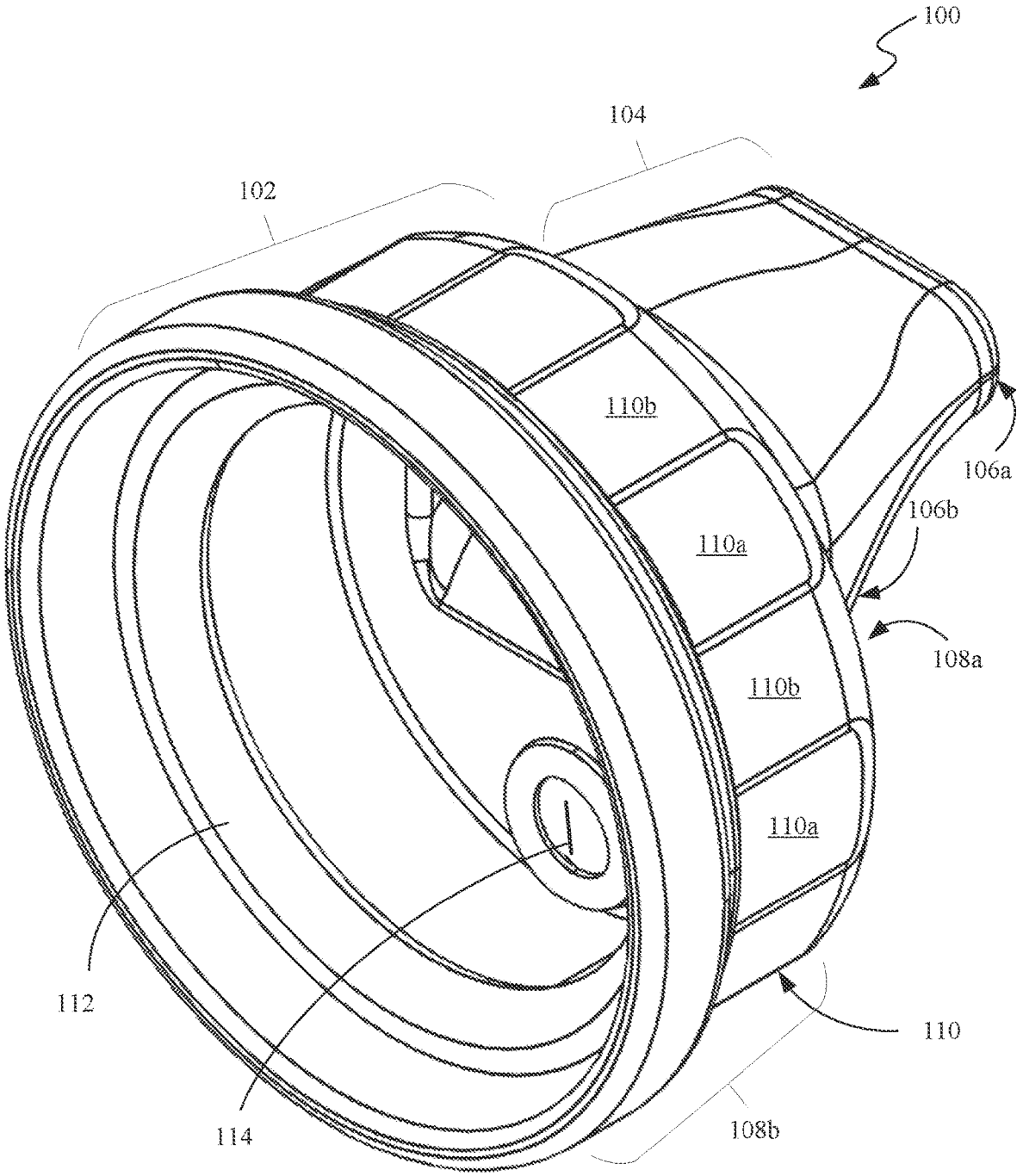
FIG. 1A is an isometric view of a sip lid configured in accordance with some embodiments of the present technology.
Figure 1B:
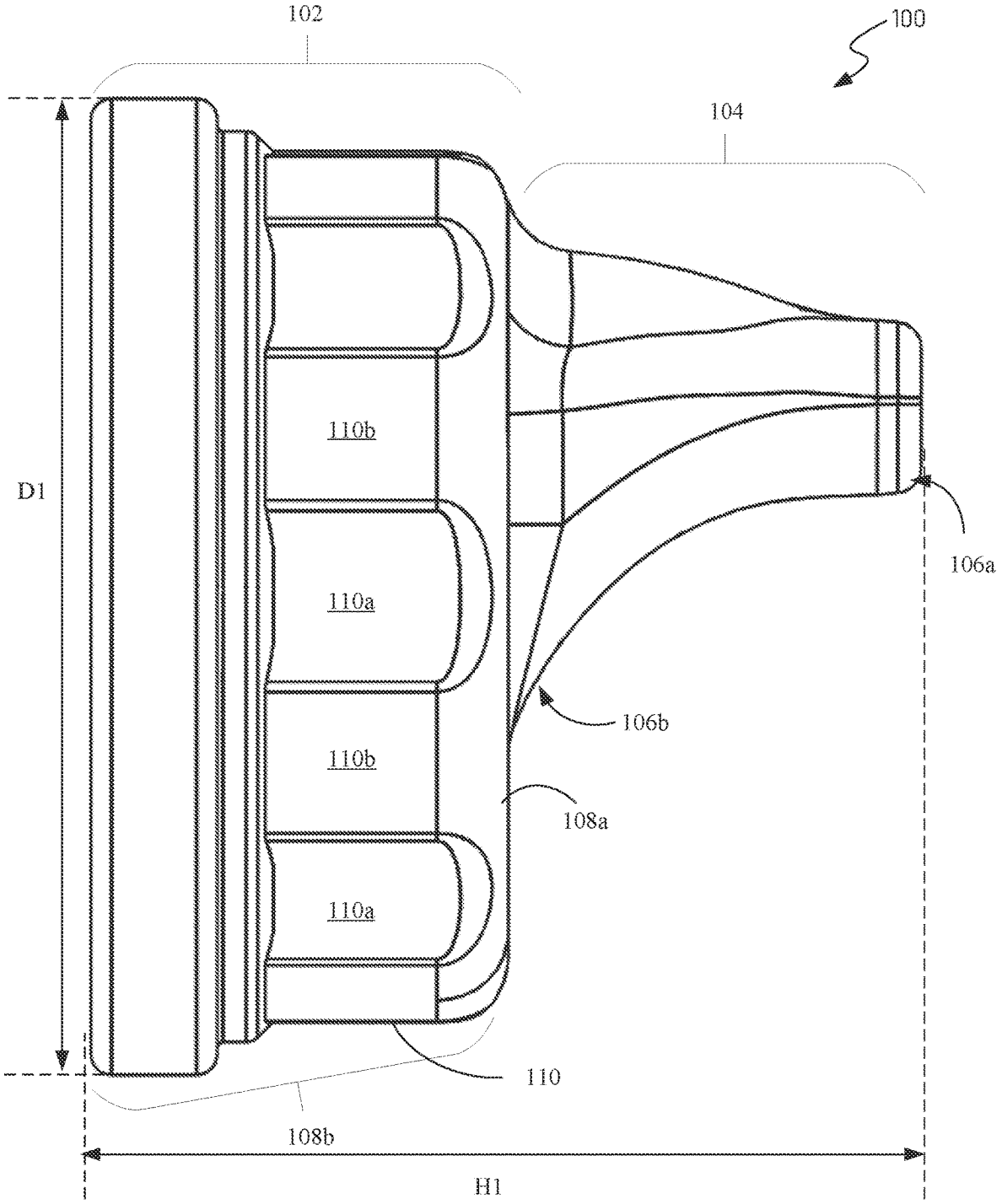
FIG. 1B is a first side view of the sip lid of FIG. 1A in accordance with some embodiments of the present technology.
Figure 1C:
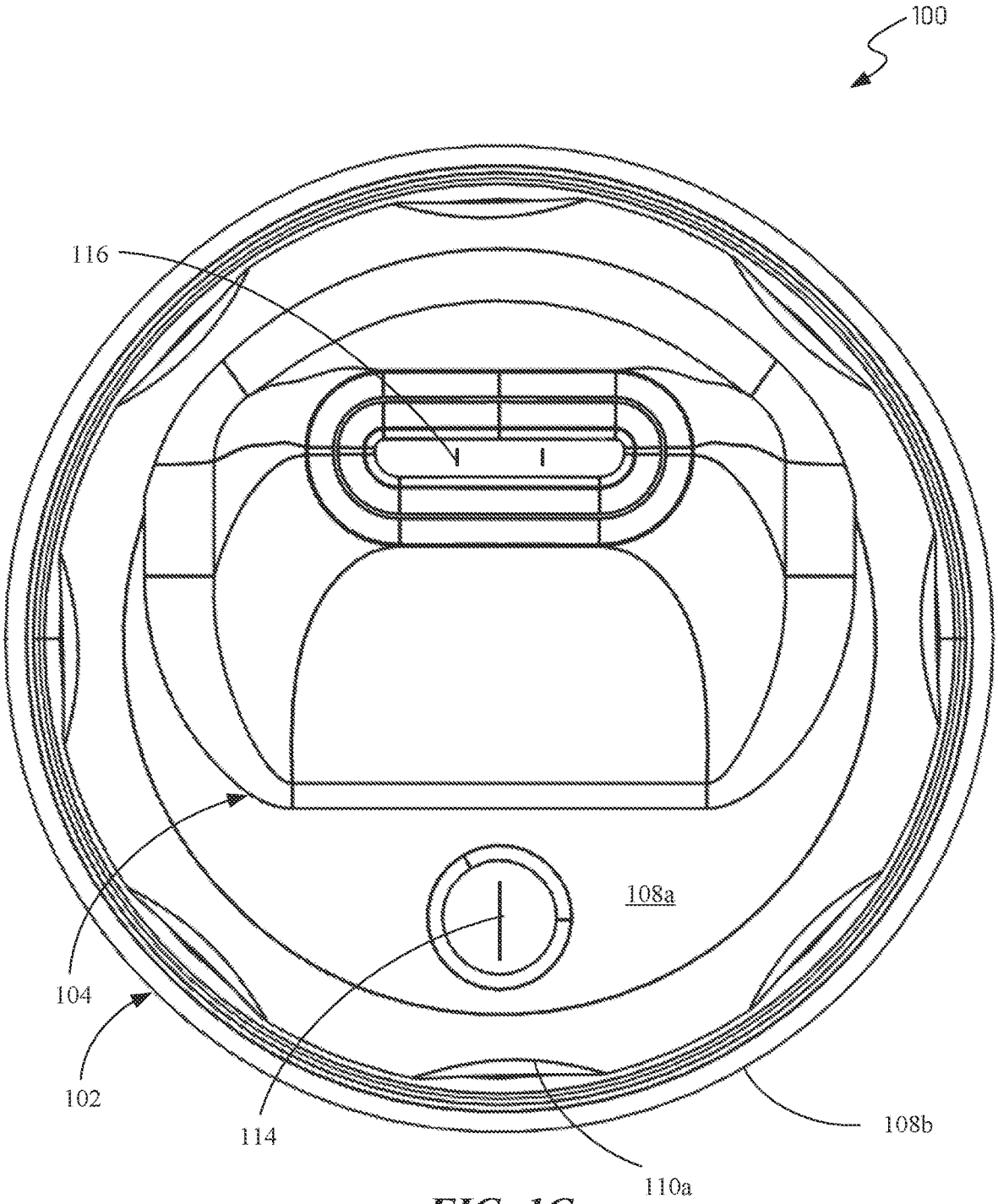
FIG. 1C is a bottom view of the sip lid of FIG. 1A in accordance with some embodiments of the present technology.
Figure 1D:
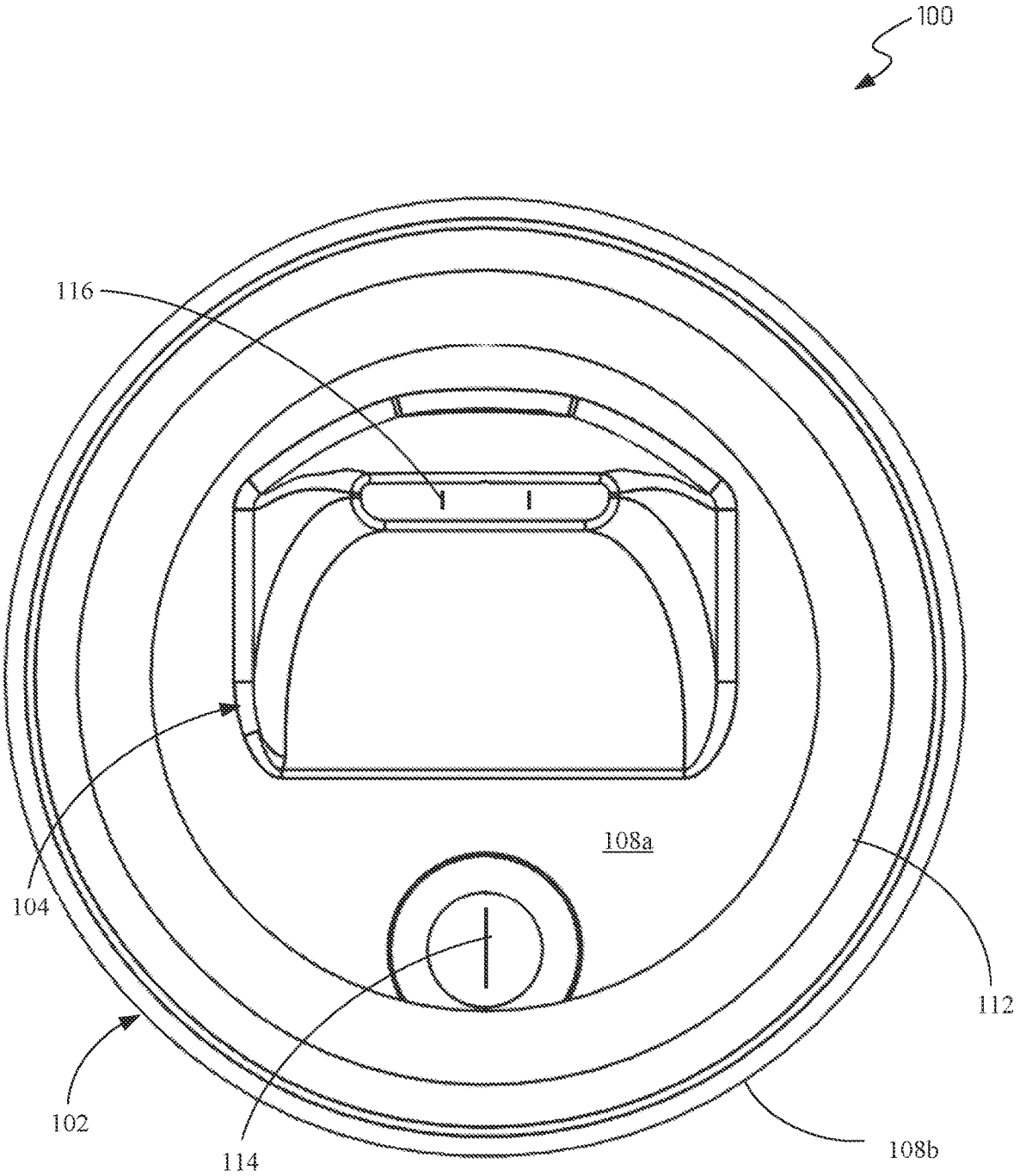
FIG. 1D is a top view of the sip lid of FIG. 1A in accordance with some embodiments of the present technology.
Figure 1E:
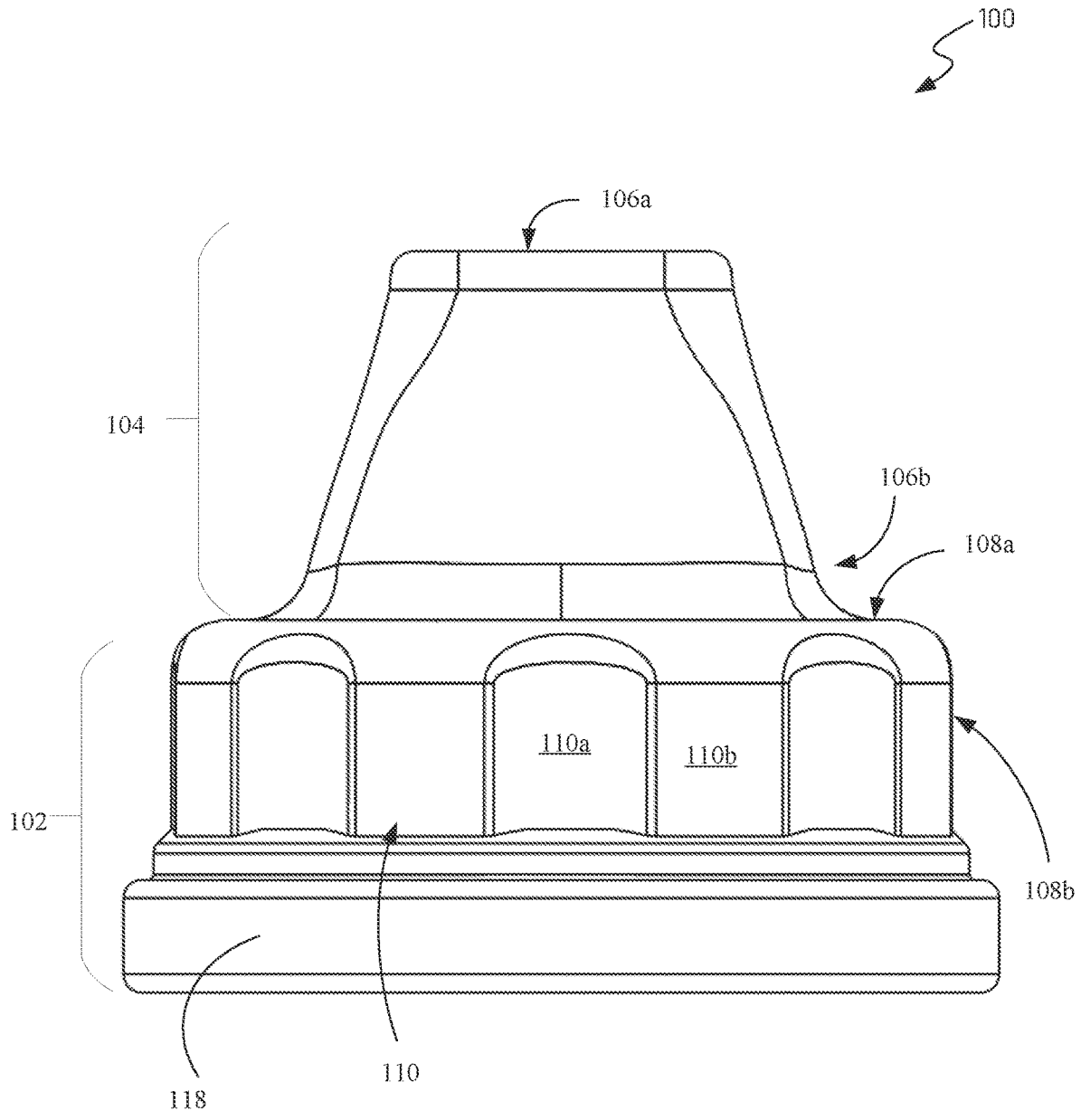
FIG. 1E is a second side view of the sip lid of FIG. 1A in accordance with some embodiments of the present technology.

FIGS. 1A-1E illustrate different views of a sip lid 100 configured in accordance with some embodiments of the present technology. More specifically, FIG. 1A is an isometric view of the sip lid 100, FIG. 1B is a first side view of the sip lid 100, FIG. 1C is a top view of the sip lid 100, FIG. 1D is a bottom view of the sip lid 100, and FIG. 1E is a second side view of the sip lid 100. The sip lid 100 includes a base component 102 and a spout component 104. The sip lid 100 including the spout component 104 and the base component 102 is made of an elastic (e.g., flexible, deformable, resilient, stretchable, etc.) material. The material can be silicone such as medical-grade silicone. The sip lid 100 is monolithic such that the spout component 104 and the base component 102 are a single unitary structure. For example, the sip lid material can be molded as a single integral structure using a single mold or other manufacturing procedure to form a single unitary structure.

The base component 102 of the sip lid 100 is configured to be stretched around differently sized and shaped mouths of drinking vessels to couple the sip lid 100 to the drinking vessels. When the sip lid 100 is stretched around a mouth and/or neck of a drinking vessel, the base component 102 can form a friction fit with the mouth and/or neck of the drinking vessel thereby forming a liquid-tight seal between the base component 102 and the drinking vessel.

The spout component 104 is shaped and sized to be received within a child's mouth. For example, the spout component 104 is shaped and sized to be used by a toddler. The spout component 104 includes a first end region 106*a* and a second end region 106*b*. The first end region 106*a* includes one or more openings (e.g., openings 116 shown in FIGS. 1C and 1D). The openings 116 extend through the first end region 106*a* of the spout component 104 and allow liquid to be extracted through the first end region 106*a* as a child applies suction to the spout component 104. The openings 116 can have different shapes. In some embodiments, the openings 116 have a shape of a thin slit. In some embodiments, the openings have circular or elliptical shapes. For example, the opening 116 can correspond to a slit extending through the first end region 106*a* of the spout component 104. When a child is sucking liquid from the drinking vessel, the slit formed by the elastic material expands to allow the liquid to flow through. When no suction is applied, the slit remains closed or nearly closed (e.g., to prevent the liquid from spilling when the drinking vessel is tipped). In some embodiments, the one or more openings 114 can be sealable with a flap (not shown in the drawings).

The second end region 106*b* is positioned opposite to the first end region 106*a* so that the base component 102 extends from the second end region 106*b* and at least partially surrounds the spout component 104 (e.g., at least half of a periphery). The spout component 104 has an elliptical peripheral shape that is configured to fit comfortably in a child's mouth. The base component 102 has a circular shape that is configured to fit over vessel mouths (e.g., circular or elliptical bottle mouths).

The base component 102 includes a top portion 108*a* and a side portion 108*b*. The side portion 108*b* extends perpendicularly or substantially perpendicularly from the top portion 108*a*. As shown in FIG. 1E, the top portion 108*a* includes a top surface of the component 102. The second end region 106*b* of the spout component 104 extends upwards from the top portion 108*a* of the base component. The side portion 108*b* extends downward from the top portion 108*a*. When the sip lid 100 is coupled with a mouth of a drinking vessel, the side portion 108*b* is configured to be at least partially in contact a the neck of the drinking vessel and the top portion 108*a* is configured to be positioned on top of the opening defined by the mouth of the drinking vessel.

The side portion 108*b* of the base component 102 can include smooth and non-smooth portions. For example, a peripheral edge 118 of the side portion 108*b* in FIG. 1E includes a smooth surface. In some embodiments, the side portion 108*b* includes a non-smooth grip portion 110 that includes a plurality of grip regions 110*a* that form indentations or protrusions along an outer surface of the side portion 108*b*. The grip regions 110 are separated by smooth regions 110*b* (e.g., regions that are not indented or protruded). The grip portion 110 is configured to improve a user's grip on the sip lid 100 when the user is coupling the sip lid 100 with, or uncoupling the sip lid from, a drinking vessel.

In some embodiments, an inner surface of the side portion 108*b* includes one or more ridges 112 as shown in FIGS. 1A and 1D. The one or more ridges 112 can include one or more raised portions (e.g., rings) that extend around a portion (e.g., at least half of a periphery) of the base component 102. The one or more ridges 112 can extend radially inward from the inner surface of the side portion 108*b* of the base component 102. For example, as shown in FIG. 1D, an edge of the base component 102 can have a diameter (e.g., diameter D1 in FIG. 1D) ranging from about 45 mm to about 50 mm while the ridge 112 can have a diameter (e.g., diameter D2 in FIG. 1D) ranging from about 30 mm to about 35 mm. The one or more ridges 112 are configured to form a liquid tight seal between the base component 102 and differently sized mouths of drinking vessels. For example, the one or more ridges 112 are configured to concur within threads around a mouth of the drinking vessel to form the liquid-tight seal. The differently sized mouths of drinking vessels can have diameters ranging from about 30 mm to about 55 mm. The liquid-tight seal formed by the one or more ridges 112 coupled with a neck of a drinking vessel is described with respect to FIG. 2C. In some embodiments, the base component 102 also includes one or more ridges that extend outward from an outer surface of the side portion 108*b*. The side portion 108*b* can include ridges that extend inward as well as outward from the side portion 108*b*.

In some embodiments, the top portion 108*a* of the base component 102 includes one or more openings (e.g., an opening 114 in FIGS. 1A, 1C, and 1D) that extend through the top portion 108*a*. The one or more openings 114 are configured to allow airflow to the drinking vessel when a child is sucking liquid through the openings 116 of the spout component 104 (e.g., to prevent negative pressure within the drinking vessel). The one or more openings 114 can have different shapes and sizes. For example, the one or more openings can have an elongated shape (e.g., an oval, elliptical, or slit shape) or a circular shape. The one or more openings 114 can have a greater size than the one or more openings 116. The one or more openings 114 can be sealable. For example, the opening 114 can correspond to a slit extending through the top portion 108*a*. When a child is sucking liquid from the drinking vessel, the top portion 108*a* made of the elastic material deforms thereby expanding the slit to allow air to flow through the slit. When no suction is applied, the slit remains closed (e.g., to prevent liquid from spilling). In some embodiments, the one or more openings 116 can be sealable with a flap (not shown in the drawings).

Figure 2A:
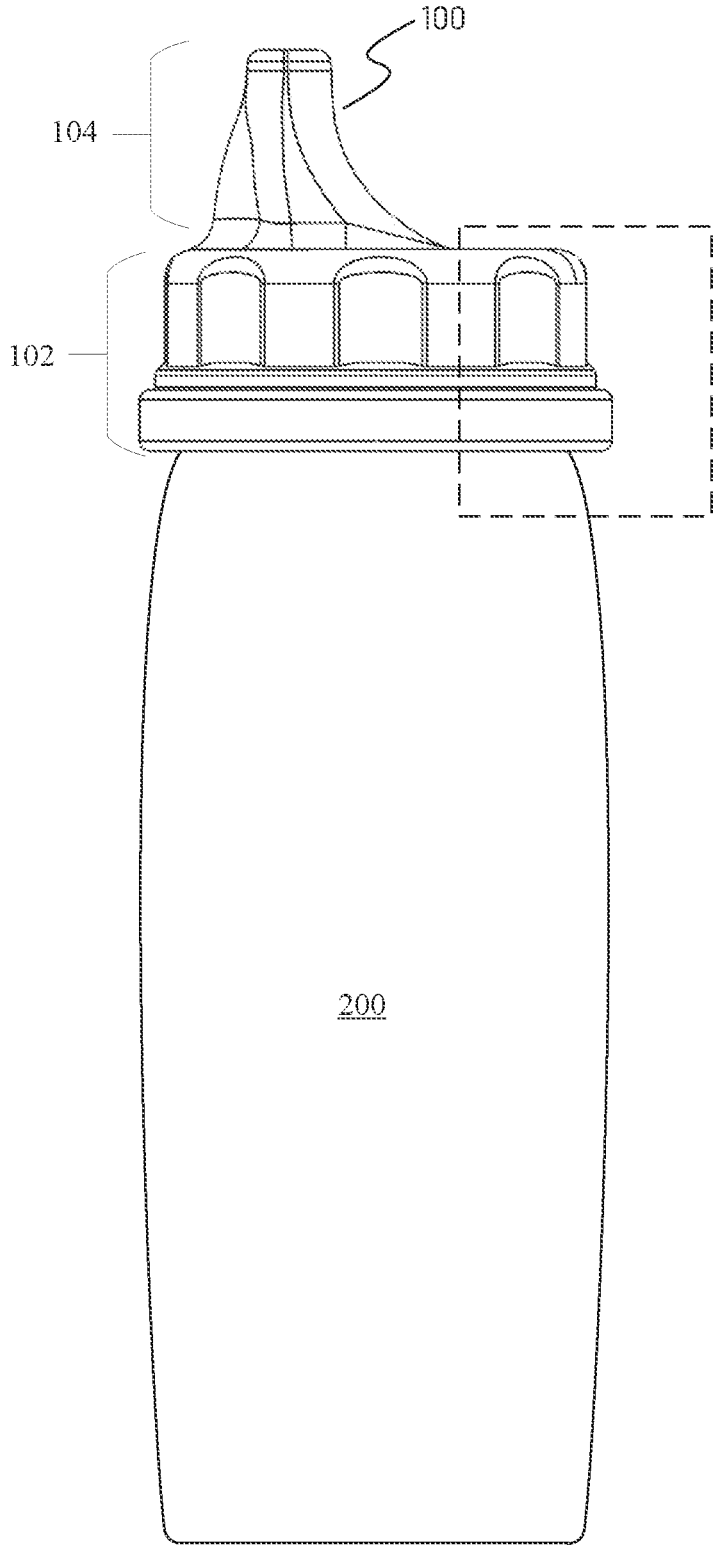
FIG. 2A is a side view of the sip lid of FIG. 1A coupled with a drinking vessel in accordance with some embodiments of the present technology.
Figure 2B:
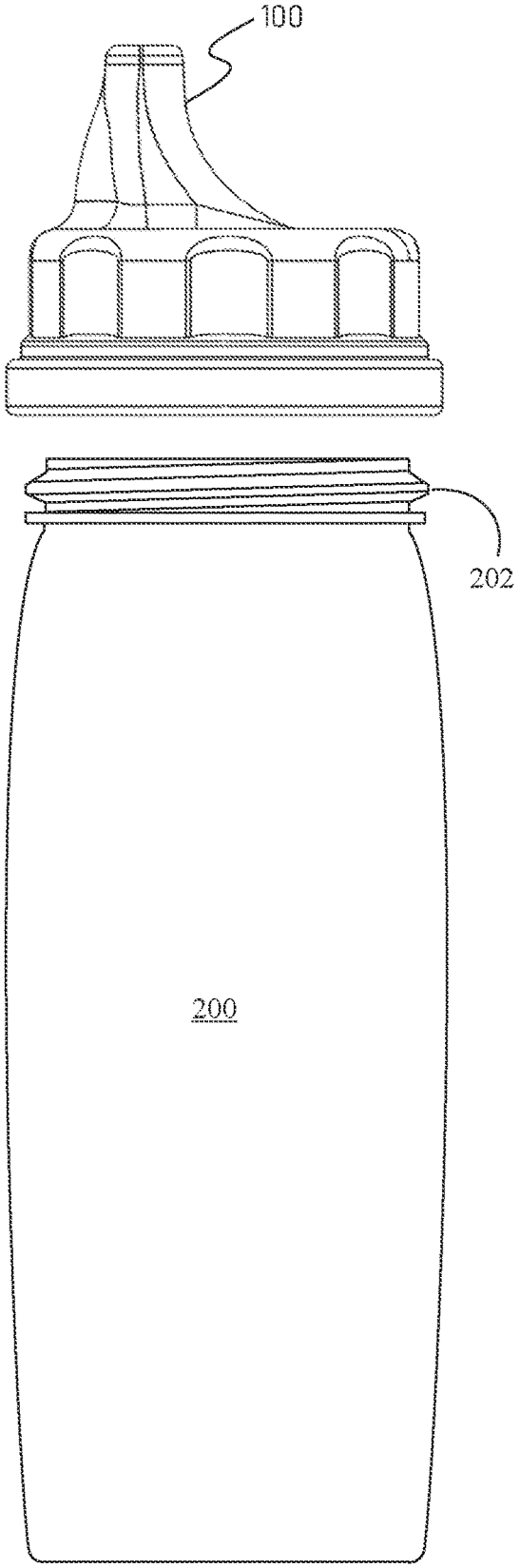
FIG. 2B is a side view of the sip lid of FIG. 1A uncoupled from the drinking vessel of FIG. 2A in accordance with some embodiments of the present technology.
Figure 2C:
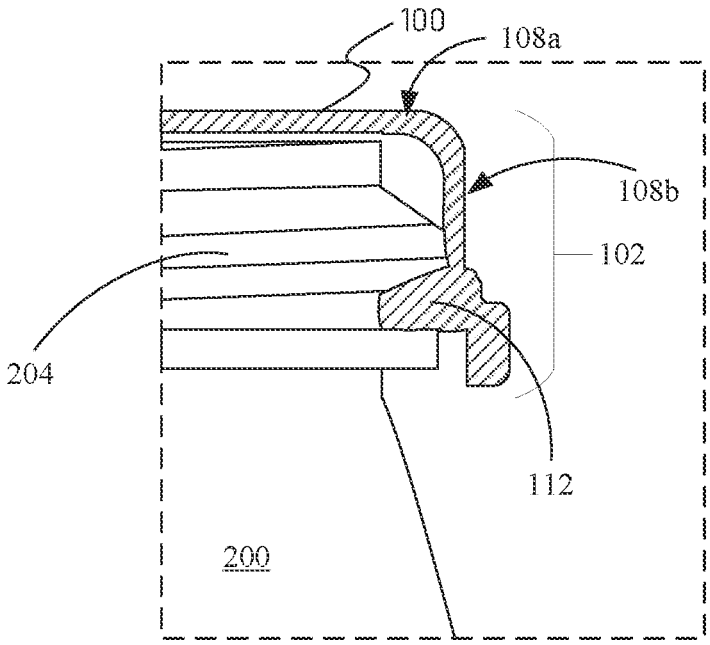
FIG. 2C is a partial cross-sectional view of the sip lid of FIG. 1A coupled with the drinking vessel representing area A in FIG. 2A in accordance with some embodiments of the present technology.

FIGS. 2A and 2B are side views of the sip lid 100 coupled and uncoupled with a drinking vessel 200, respectively, in accordance with some embodiments of the present technology. The drinking vessel 200 can correspond to, for example, a standard-sized baby bottle. The drinking vessel 200 includes a mouth having a diameter D3 (e.g., the diameter D3 ranging from about 30 mm to about 55 mm). As shown in FIG. 2B, the mouth of the drinking vessel 200 includes external threads 202 for coupling the drinking vessel 200 to conventional threaded lids and caps. However, the sip lid 100 is configured to couple with the drinking vessel without threaded engagement (i.e., the sip lid 100 does not include threads). Instead, the sip lid 100 is configured to couple with the drinking vessel 200 by a friction fit between the base component 102 and the neck of the drinking vessel. The sip lid 100 can also be configured to couple with the drinking vessel 200 by contacting the one or more ridges 112 (e.g., as shown in FIGS. 1A and 1D) with the threads 202 of the drinking vessel 200. FIG. 2C is a partial cross-sectional view of the sip lid 100 coupled with the drinking vessel 200 representing area A shown in FIG. 2A. As shown, when the sip lid 100 is coupled with the drinking vessel 200, the ridge 112 of the base component 102 of sip lid 100 is in contact with the threads 204 of the neck of the drinking vessel 200 to form a liquid-tight seal. In particular, the elastic material of the sip lid 100 allows the ridge 112 to concur with the shape of the threads 204 so that the sip lid 100 conceals the mouth of the drinking vessel in a manner that prevents liquid from the drinking vessel 200 from spilling out.

Figure 3A:
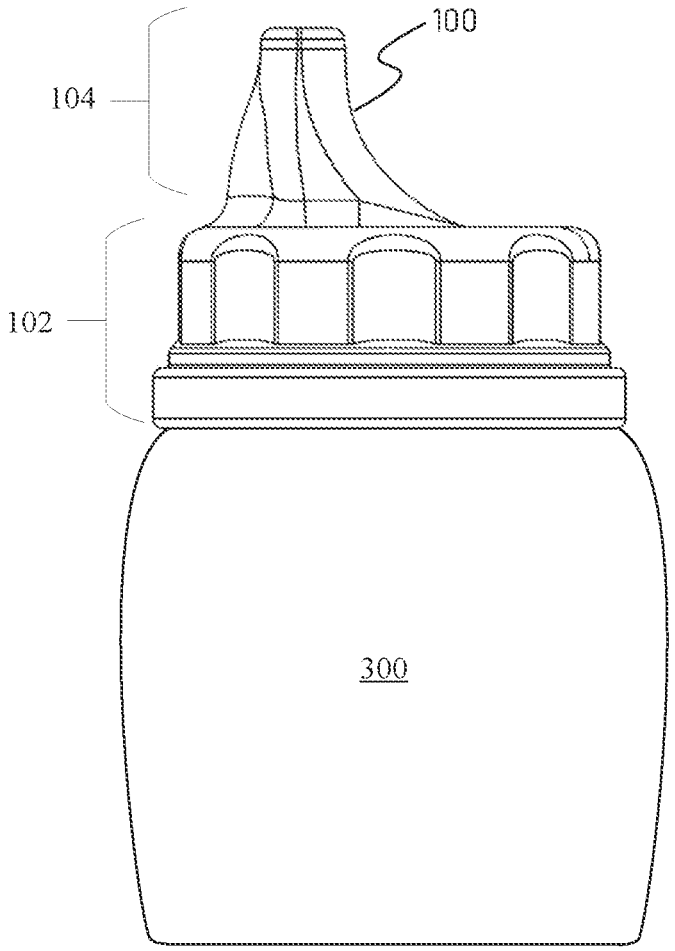
FIG. 3A is a side view of the sip lid of FIG. 1A coupled with a drinking vessel in accordance with some embodiments of the present technology.
Figure 3B:
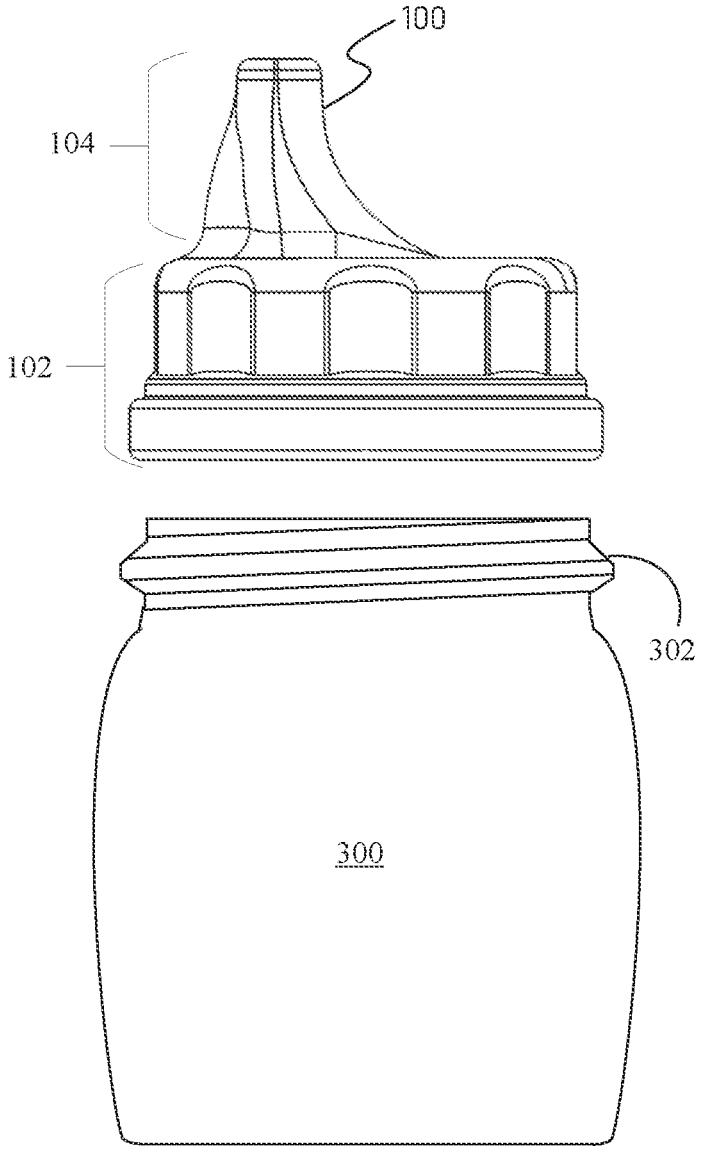
FIG. 3B is a side view of the sip lid of FIG. 1A uncoupled from the drinking vessel of FIG. 3A in accordance with some embodiments of the present technology.

FIGS. 3A and 3B are side views of the sip lid 100 coupled and uncoupled with a drinking vessel 300, respectively, in accordance with some embodiments of the present technology. The drinking vessel 300 includes a mouth having a diameter (e.g., diameter D4 ranging from about 30 mm to about 55 mm). As shown in FIG. 3B, the mouth of the drinking vessel 200 includes external threads 302. As shown, the drinking vessel 300 has a different shape than the drinking vessel 200 in FIGS. 2A-2B. In particular, the drinking vessel can have a mouth that has a different shape and/or size than the mouth of the drinking vessel 200. For example, the diameter D4 of the mouth of the drinking vessel 300 is greater than the diameter D3 of the mouth of the drinking vessel 200. The drinking vessel 300 can include different coupling features than the drinking vessel 200. For example, the threads 302 of the drinking vessel 300 can have a different thread pitch than the threads 202 of the drinking vessel 200. Alternatively, the drinking vessel 300 can include different types of coupling features than threads (e.g., ridges or dots) or not include any coupling features (e.g., the neck of the drinking vessel 300 is smooth).

The drinking vessels 200 and 300 in FIGS. 2A-3B are bottles that include threads. However, the sip lid 100 is configured to be used with a variety of different types of drinking vessels (e.g., cups, mugs, cans, and glasses) including mouths of different sizes and/or shapes. The drinking vessels can be made of different materials (e.g., plastic, glass, or metal). The drinking vessel may or may not include coupling features (e.g., external threads, ridges, or dots).

Figure 4:
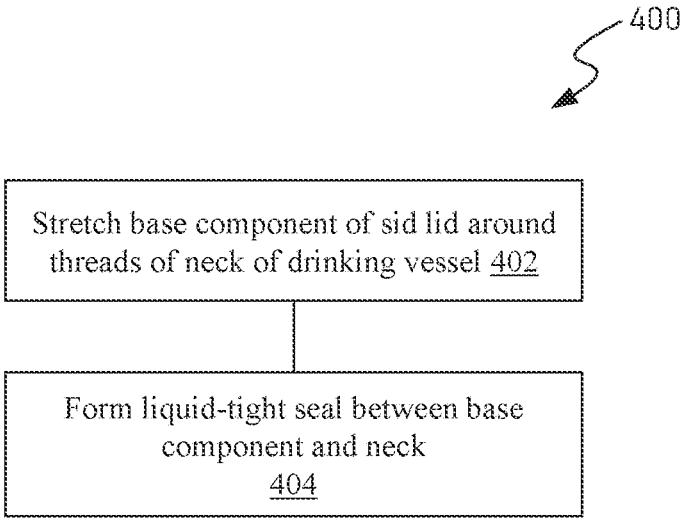
FIG. 4 is a block diagram of a method of using the sip lid of FIG. 1A in accordance with some embodiments of the present technology.

FIG. 4 is a block diagram of a method 400 of using the sip lid 100 in accordance with embodiments of the present technology. At step 402, the method 400 includes stretching a base component of the sip lid (e.g., the base component 102 of the sip lid 100 in FIGS. 1A-1E) to extend around threads of a neck of a drinking vessel (e.g., the threads 202 of the drinking vessel 200 in FIGS. 2A-2C). This step can include positioning the sip lid over the mouth of the drinking vessel and pressing it against the top lip of the drinking vessel so that the flexible material of the base component stretches, expands, or otherwise extends around the neck (e.g., upper portion) of the drinking vessel (e.g., and any threads or connectors thereon) to allow the sip lid to be positioned around the neck of the drinking vessel. For example, when a drinking vessel is positioned on a table, a user can position the sip lid on top of the mouth of the drinking vessel and couple the sip lid with the drinking vessel by pressing the sip lid down using just one hand, without the need to physically stretch opposing sides of the base component apart. Coupling the sip lid with the drinking vessel thereby does not require rotation of the sip lid and/or the drinking vessel. As a result of stretching the base component of the sip lid around the threads, at step 404 the method 400 includes forming a liquid-tight seal. As explained above, the sip lid 100 can be made of an elastic material (e.g., silicone) and does not include threads. Therefore, the base component is coupled with the neck of the drinking vessel without using threaded engagement. Instead, for example, a ridge (e.g., ridge 112 in FIGS. 1A, 1D, and 2C) on an inner surface of the base component is positioned in contact with the threads to form the liquid-tight seal when the sip lid is stretched around the neck of the drinking vessel. The sip lid can therefore be stretched around drinking vessels having mouths and/or necks of different sizes, shapes, and/or coupling features (e.g., threads with different pitches). For example, the base component of the sip lid is configured to be stretched over the necks of drinking vessels having diameters ranging from about 30 mm to about 55 mm.

At 402, the method 400 includes uncoupling the sip lid from the drinking vessel by pulling (e.g., translating in a linear manner) at least one of the sip lid and the drinking vessel relative to each other in an opposite direction until the sip lid is no longer in contact with the drinking vessel. For example, transitioning from FIG. 2A to FIG. 2B, the sip lid 100 can be uncoupled from the drinking vessel 200 by pulling the sip lid 100 upright. The elastic material of the sip lid 100 can deform to allow the ridge 112 in FIG. 2C to detach from the threads 202 when the sip lid 100 is pulled apart from the drinking vessel. The pulling of at least one of the sip lid and the drinking vessel relative to each other does not include rotating.

The method 400 can further include attaching the sip lid to a neck of another drinking vessel (e.g., drinking vessel 300 in FIGS. 3A and 3B) after uncoupling the sip lid from the drinking vessel. For example, the neck of the drinking vessel 300 in FIGS. 3A and 3B can be shaped and/or sized differently than the neck of the drinking vessel 200 in FIGS. 2A-2C.

EXEMPLARY EMBODIMENTS

In accordance with some embodiments, a sip lid for a children's drinking vessel includes a spout component having a first end region and a second end region opposite to the first end region. The spout component is shaped and sized to be received within a child's mouth. The first end region comprises one or more openings configured to allow liquid to be extracted through the spout component when the child is applying suction to the spout component. The sip lid also includes a base component extending from the second end region of the spout component and surrounding the spout component. The base component is made from an elastic material configured to allow the base component to stretch over differently sized mouths of drinking vessels to form a liquid-tight seal between the base component and the drinking vessels.

In some embodiments, the base component is configured to couple with and form the liquid-tight seal with mouths of drinking vessels having diameters ranging from about 30 mm to about 55 mm.

In some embodiments, the base component is configured to couple with mouths of drinking vessels having different shapes.

In some embodiments, the spout component and the base component are made of the same elastic material. For example, the elastic material is silicone.

In some embodiments, the sip lid is configured to form the liquid-tight seal between the sip lid and the drinking vessel by friction fit. The base component does not include threads.

In some embodiments, the spout component has an elliptical outer peripheral shape and the base component has a circular outer peripheral shape.

In some embodiments, the base component includes a top portion and a side portion that extends perpendicularly from the top portion. The spout component extends from the top portion of the base component. The side portion is configured to extend over to the mouths of drinking vessels.

In some embodiments, the side portion comprises an outer surface having a plurality of grip regions that form protrusions or indentations along the outer surface.

In some embodiments, an inner surface of the side portion includes one or more ridges configured to form the liquid-tight seal between the base component and the drinking vessel. The one or more ridges are configured to concur within threads of a neck of the drinking vessel to form the liquid-tight seal.

In some embodiments, the top portion of the base component further includes an opening extending through the top portion of the base component.

In accordance with some embodiments, a sip lid for a vessel includes a spout component and a base component. The spout component has a first end region and a second end region opposite to the first end region. The first end region includes one or more openings configured to allow liquid to be extracted through the spout component. The base component extends from the second end region of the spout component and surrounds the spout component. The base component is made from an elastic material configured to allow the base component to stretch over differently sized mouths of drinking vessels to form a liquid-tight seal between the base component and the drinking vessels.

In some embodiments, the base component is configured to couple with and form the liquid-tight seal with mouths of drinking vessels having diameters ranging from about 30 mm to about 55 mm.

In some embodiments, the base component is configured to couple with mouths of drinking vessels having different shapes (e.g., circular, oval, or elliptical).

In some embodiments, a method of using a sip lid includes stretching a base component of the sip lid around threads of a neck of a drinking vessel to form a liquid-tight seal between the base component and the neck without using threads. The sip lid includes a spout component having a first end region with openings configured to allow for liquid extraction therethrough and a second end region coupled to the base component. The base component of the sip lid is configured to be stretched over the necks of drinking vessels having diameters ranging from about 30 mm to about 55 mm.

In some embodiments, the method includes uncoupling the sip lid from the drinking vessel by pulling at least one of the sip lid and the drinking vessel relative to each other in an opposite direction until the sip lid is no longer in contact with the drinking vessel. Pulling of at least one of the sip lid and the drinking vessel relative to each other does not include rotating.

In some embodiments, the drinking vessel is a first drinking vessel, the neck is a first neck. The method further includes uncoupling the sip lid from the first drinking vessel and attaching the sip lid to a second neck of a second drinking vessel. The second neck is being shaped and/or sized differently than the first neck.

CONCLUSION

The above detailed description of embodiments of the technology are not intended to be exhaustive or to limit the technology to the precise form disclosed above. Although specific embodiments of, and examples for, the technology are described above for illustrative purposes, various equivalent modifications are possible within the scope of the technology as those skilled in the relevant art will recognize. For example, although steps are presented in a given order, alternative embodiments can perform steps in a different order. The various embodiments described herein can also be combined to provide further embodiments.

From the foregoing, it will be appreciated that specific embodiments of the technology have been described herein for purposes of illustration, but well-known structures and functions have not been shown or described in detail to avoid unnecessarily obscuring the description of the embodiments of the technology. Where the context permits, singular or plural terms can also include the plural or singular term, respectively.

Moreover, unless the word "or" is expressly limited to mean only a single item exclusive from the other items in reference to a list of two or more items, then the use of "or" in such a list is to be interpreted as including (a) any single item in the list, (b) all of the items in the list, or (c) any combination of the items in the list. Additionally, the term "comprising" is used throughout to mean including at least the recited feature(s) such that any greater number of the same feature and/or additional types of other features are not precluded. It will also be appreciated that specific embodiments have been described herein for purposes of illustration, but that various modifications can be made without deviating from the technology. Further, while advantages associated with some embodiments of the technology have been described in the context of those embodiments, other embodiments can also exhibit such advantages, and not all embodiments need necessarily exhibit such advantages to fall within the scope of the technology. Accordingly, the disclosure and associated technology can encompass other embodiments not expressly shown or described herein.

I claim:

1. A sip lid for a children's drinking vessel, comprising:

a spout component having a first end region and a second end region opposite to the first end region, wherein— the spout component is shaped and sized to be received within a child's mouth, and the first end region comprises one or more openings configured to allow liquid to be extracted through the spout component when the child is applying suction to the spout component; and a base component having (i) a top portion extending from the second end region of the spout component and surrounding the spout component, and (ii) a side portion extending away from the top portion and configured to extend around a neck of the children's drinking vessel, wherein the side portion comprises— a first inner surface, one or more ridges extending radially inward from the first inner surface and configured to concur within threads along the neck, and a peripheral edge region having a second inner surface with a larger diameter than that of the first inner surface around a circumference of the peripheral edge region, the second inner surface being substantially parallel to the first inner surface; and the base component is made from an elastic material configured to allow the base component to stretch over differently sized mouths of drinking vessels to form a liquid-tight seal between the base component and the drinking vessels.

2. The sip lid of claim 1, wherein the base component is configured to couple with and form the liquid-tight seal with mouths of drinking vessels having diameters ranging from about 30 mm to about 55 mm.

3. The sip lid of claim 1, wherein the base component is configured to couple with mouths of drinking vessels having different shapes.

4. The sip lid of claim 1, wherein the spout component and the base component are made of the same elastic material.

5. The sip lid of claim 4, wherein the elastic material is silicone.

6. The sip lid of claim 1, wherein the sip lid is configured to form the liquid-tight seal between the sip lid and the drinking vessel by friction fit.

7. The sip lid of claim 5, wherein the base component does not include threads.

8. The sip lid of claim 1, wherein:

the spout component has an elliptical outer peripheral shape, and the base component has a circular outer peripheral shape.

9. The sip lid of claim 1, wherein:

the side portion extends perpendicularly from the top portion, and the spout component extends from the top portion of the base component.

10. The sip lid of claim 1, wherein the side portion comprises an outer surface having a plurality of grip regions separated by a plurality of flat regions, the grip regions forming protrusions or indentations along the outer surface.

11. The sip lid of claim 1, wherein the one or more ridges are configured to concur within one or more roots of the threads of a neck of the drinking vessel to form the liquid-tight seal.

12. The sip lid of claim 9, wherein the top portion of the base component includes an opening extending through the top portion of the base component.

13. A lid for a vessel, comprising:

a spout component having a first end region and a second end region opposite to the first end region, wherein— the first end region comprises one or more openings configured to allow liquid to be extracted through the spout component; and a base component having (i) a top portion extending from the second end region of the spout component and surrounding the spout component, and (ii) a side portion extending away from the top portion, wherein the side portion comprises— a first inner surface, one or more ridges extending radially inward from the first inner surface and configured to concur within threads along a neck of the vessel, and a peripheral edge region having a second inner surface with a larger diameter than that of the first inner surface around a circumference of the peripheral edge region, the second inner surface being substantially parallel to the first inner surface, and the base component is made from an elastic material configured to allow the base component to stretch over differently sized mouths of drinking vessels to form a liquid-tight seal between the base component and the drinking vessels.

14. The lid of claim 13, wherein the base component is configured to couple with and form the liquid-tight seal with mouths of drinking vessels having diameters ranging from about 30 mm to about 55 mm.

15. The lid of claim 13, wherein the base component is configured to couple with mouths of drinking vessels having different shapes.

16. A method of using a sip lid, comprising:

stretching a base component of the sip lid around threads of a neck of a drinking vessel to form a liquid-tight seal between the base component and the neck without using threads, wherein— the base component includes (i) a top portion, and (ii) a side portion extending away from the top portion, the side portion has a first inner surface comprising one or more ridges, the side portion includes a peripheral edge region having a second inner surface with a larger diameter than that of the first inner surface around a circumference of the peripheral edge region, the second inner surface being substantially parallel to the first inner surface, the liquid-tight seal is formed by positioning the one or more ridges around the threads of the neck of the drinking vessel so that the one or more ridges concur within one or more roots of the threads of the neck of the drinking vessel, the sip lid comprises a spout component having a first end region with openings configured to allow for liquid extraction therethrough and a second end region coupled to the base component, and the base component of the sip lid is configured to be stretched over necks of drinking vessels having diameters ranging from about 30 mm to about 55 mm.

17. The method of claim 16, further comprising uncoupling the sip lid from the drinking vessel by pulling at least one of the sip lid and the drinking vessel relative to each other in an opposite direction until the sip lid is no longer in contact with the drinking vessel.

18. The method of claim 17, wherein pulling at least one of the sip lid and the drinking vessel relative to each other does not include rotating.

19. The method of claim 16, wherein the drinking vessel is a first drinking vessel, the neck is a first neck, and the method further comprises:

uncoupling the sip lid from the first drinking vessel; and attaching the sip lid to a second neck of a second drinking vessel, the second neck being shaped and/or sized differently than the first neck.

20. A lid for a baby bottle, comprising:

a spout component having a first end region and a second end region opposite to the first end region, wherein— the spout component is shaped and sized to be received within a mouth of a child, and the first end region comprises at least one opening configured to allow liquid to be extracted through the spout component when the child is applying suction to the spout component; and a base component having:

(i) a top portion extending from the second end region of the spout component and surrounding the spout component and configured to extend around a neck of the baby bottle, and (ii) a side portion extending from the top portion away from the spout component, wherein the side portion comprises— a first inner surface, one or more ridges extending radially inward from the first inner surface and configured to concur within threads along the neck, and a peripheral edge region having a second inner surface with a larger diameter than that of the first inner surface around a circumference of the peripheral edge region, the second inner surface being substantially parallel to the first inner surface, wherein the side portion of the base component is configured to stretch around differently sized bottle necks to form a liquid-tight seal between the base component and the bottle necks, and wherein the base component and the spout component are made from silicone.

21. The lid of claim 20, wherein the at least one opening of the first end region has a shape of a slit.

22. The lid of claim 20, wherein the spout component and the base component are formed as a single integral structure.

23. The lid of claim 20, wherein the side portion comprises an outer surface having a plurality of grip regions separated by a plurality of flat regions, the grip regions defined by protrusions and/or indentations along the outer surface.

24. The lid of claim 20, wherein the top portion comprises an airflow opening having an elongated shape.

25. The sip lid of claim 1, wherein the peripheral edge region is extending away from an outer surface of the side portion and is positioned partially along the one or more ridges positioned on the first inner surface of the side portion.

26. The sip lid of claim 1, wherein the peripheral edge region is extending away from an outer surface of the side portion and is positioned at least partially below the one or more ridges positioned on the first inner surface of the side portion.

27. The lid of claim 13, wherein the side portion comprises an outer surface having a plurality of grip regions separated by a plurality of flat regions, the grip regions forming protrusions or indentations along the outer surface.

* * * * *